US006349811B1

(12) United States Patent
Chung

(10) Patent No.: US 6,349,811 B1
(45) Date of Patent: Feb. 26, 2002

(54) TWIN-SHAFT SWINGING TYPE COIN-IDENTIFYING/RECEIVING DEVICE

(76) Inventor: Johnny Chung, 2nd Floor, No. 120-13, Sec. 3, Chang Shan Road, Chung Ho City, Taipei Hsien (TW)

( * ) Notice: Subject to any disclaimer, the term of this patent is extended or adjusted under 35 U.S.C. 154(b) by 0 days.

(21) Appl. No.: 09/605,194

(22) Filed: Jun. 28, 2000

(51) Int. Cl.[7] ..... G07F 1/04
(52) U.S. Cl. ..... 194/346
(58) Field of Search ..... 194/346, 313, 194/323

(56) References Cited

U.S. PATENT DOCUMENTS 4,630,624 A * 12/1986 Turner ..... 194/346
4,782,937 A * 11/1988 Chen et al. ..... 194/346
5,040,658 A * 8/1991 Levasseur ..... 194/346
5,167,314 A * 12/1992 Levasseur ..... 194/346
5,279,404 A * 1/1994 Bruner et al. ..... 194/346
5,407,051 A * 4/1995 Wohlrab ..... 194/346
5,494,146 A * 2/1996 Kurosawa et al. ..... 194/346 X
5,496,212 A * 3/1996 Meyer-Weingartner et al. ..... 194/346 X
6,182,811 B1 * 2/2001 Wei ..... 194/346 X

* cited by examiner

*Primary Examiner*—James R. Bidwell
(74) *Attorney, Agent, or Firm*—Rosenberg, Klein & Lee

(57) ABSTRACT

A twin-shaft swinging type coin-identifying/receiving device incorporates two separate projecting actuator shafts about which two swinging members rotate. The swinging members are actuated by two swing type electromagnetic valves which save power and operate more precisely than conventional devices. The swinging members are each fitted with an arcuate slot in which a guide pin of a coin-path defining gate board travels. The gate boards are pivotally mounted at incoming ends of first and second coin releasing ways and, when rotated via the swinging members, define a coin path to be one of the first or second coin releasing ways. Due to the introduction of a separate projecting actuator shaft for each swinging member, wear on each shaft is reduced over a simple shaft shared by both swinging members which thereby prolongs the usable life of the device.

2 Claims, 6 Drawing Sheets

TWIN-SHAFT SWINGING TYPE COIN-IDENTIFYING/RECEIVING DEVICE

BACKGROUND OF THE INVENTION

1. Field of the Invention

The present invention relates to a twin-shaft swinging type coin-identifying/receiving device.

2. Description of the Prior Art

FIG. 6 shows a conventional coin receiving device of a public phone, vending machine, etc. In such coin receiving device, two gate boards 33, 34 are respectively pivotally mounted at incoming ends of two coin exits 31, 32 for closing the coin exits 31, 32 at normal time. A pivot shaft 35 is disposed on outer side of the coin receiving device and two swinging members 36, 37 are pivotally connected with the pivot shaft 35. The two swinging members 36, 37 are operated respectively by the stems 381, 391 of two cylinder-type electromagnetic valves 38, 39 to swing up and down. The gate boards 33, 34 are coupled with and driven by the swinging members 38, 39 to deflect and selectively open one of the coin exits 31, 32, permitting an inserted coin to drop out therefrom.

According to the above arrangement, the two swinging members 38, 39 are pivotally connected with the same pivot shaft 35 and leant against each other. Under such circumstance, no matter which swinging member 36 or 37 is drivingly swung by the electromagnetic valve 38 or 39, the pivot shaft 35 will be worn and the other swinging member 36 or 37 will be also worn. Therefore, after a period of use, the pivot shaft 35 and the two swinging members 36, 37 will be quickly worn out. This will lead to shaking of the swinging members in operation. Also, the excessively large gap will result in inaccurate operation and thus the two gate boards 33, 34 can be hardly driven. Therefore, the using life of the device will be shortened.

SUMMARY OF THE INVENTION

It is therefore a primary object of the present invention to provide a twin-shaft swinging type coin-identifying/receiving device including: an identifying device including a base board section and a guide board section resiliently pivotally mounted on one side of the base board section, the base board section and the guide board section defining therebetween a coin slide way, an identifying member being mounted on at least one side of the identifying device for identifying whether a coin sliding through the coin slide way is a true one or a fake one; and a receiving device installed at a bottom end of the identifying device. The receiving device is formed with an internal guide way for accepting the coin dropping from the identifying device. A bottom end of the guide way is communicated with both a first and a second coin releasing ways. Two projecting pivot shafts are radially disposed on outer side of the receiving device. Two swinging members are respectively pivotally mounted on the pivot shafts. The swinging members are respectively operated and swung by two swinging type electromagnetic valves so as to drivingly rotate two gate boards pivotally mounted at incoming ends of the first and second coin releasing ways and thus open or close the first and second coin releasing ways, whereby the coin can be guided to drop out from the first or second coin releasing way.

The present invention can be best understood through the following description and accompanying drawings wherein:

DETAILED DESCRIPTION OF THE PREFERRED EMBODIMENTS

Figure 1:
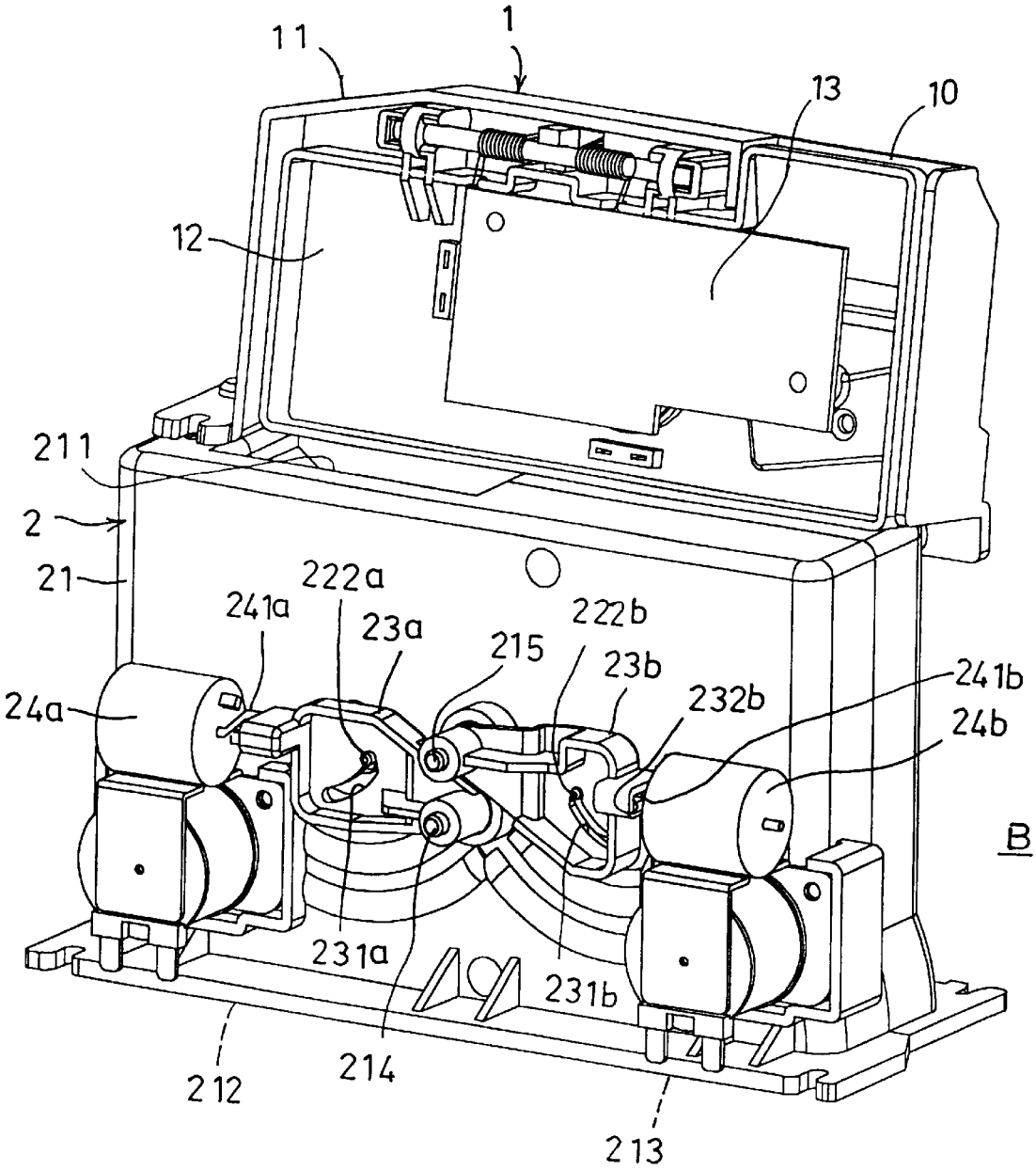
FIG. 1 is a perspective view of the present invention.
Figure 2:
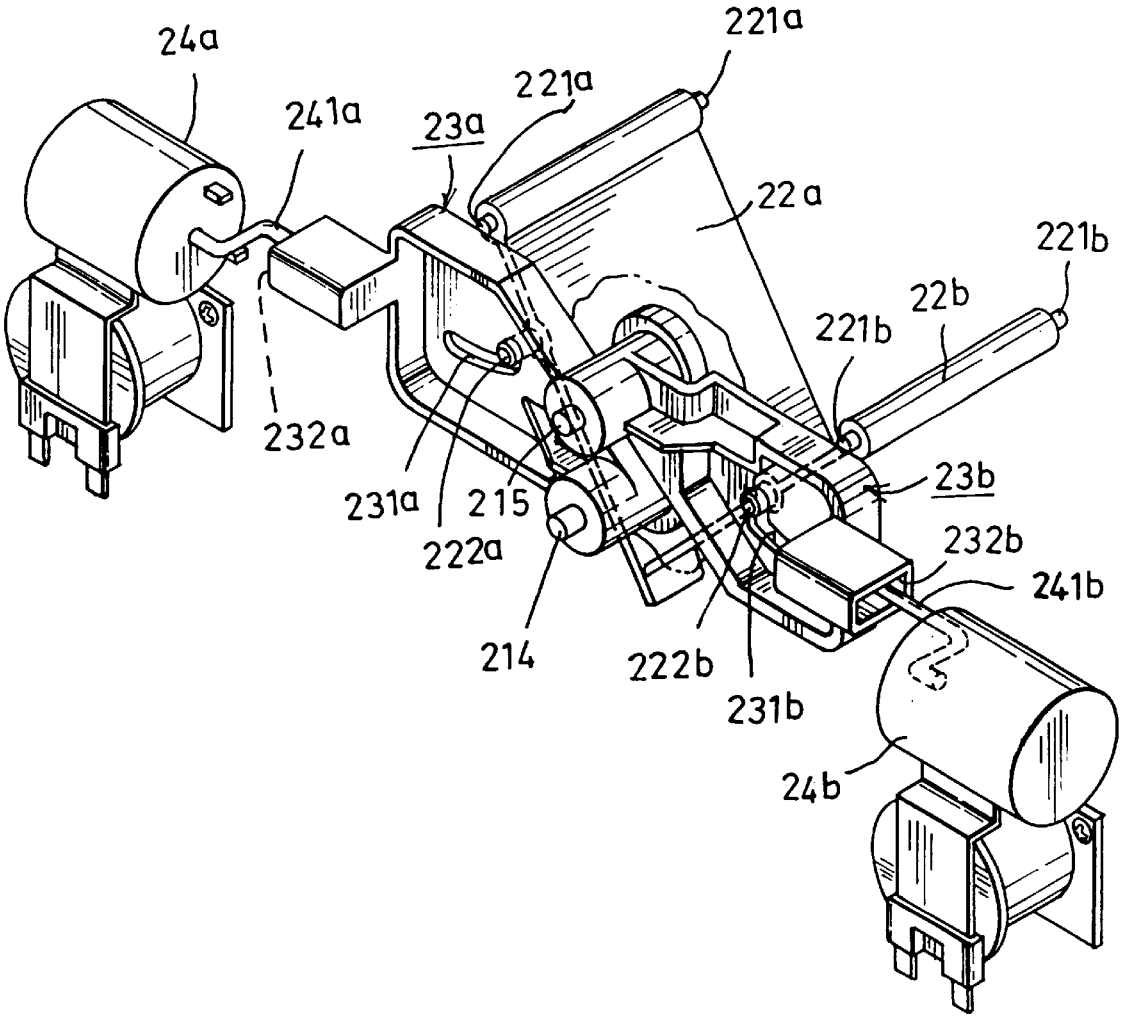
FIG. 2 is a perspective view showing the structure of the receiving device of the present invention.

Please refer to FIGS. 1 to 5. The twin-shaft swinging type coin-identifying/receiving device of the present invention includes: an identifying device 1 formed with an internal coin slide way 10, an identifying member 13 being mounted on outer side of the identifying device 1 for identifying whether the coin sliding through the coin slide way 10 is a true one or a fake one; and a receiving device 2 installed at the bottom end of the identifying device 1. The receiving device 2 has an internal guide way 211 for accepting the coin C dropping from the identifying device 1. The bottom end of the guide way 211 are communicated with both a first and a second coin releasing ways 212, 213. Two projecting shafts 214, 215 are radially disposed on one side of the receiving device 2. Two swinging members 23*a*, 23*b* are respectively pivotally mounted on the projecting shafts 214, 215. The swinging members 23*a*, 23*b* are operated and swung by two swinging type electromagnetic valves 24*a*, 24*b* so as to drivingly rotate two gate boards 22*a*, 22*b* pivotally mounted at incoming ends of the first and second coin releasing ways 212, 213 and thus open or close the coin releasing ways 212, 213. Accordingly, the coin C can be guided to drop out from the first or second coin releasing way 212, 213.

The identifying device 1 includes a base board section 11 and a guide board section 12 resiliently pivotally mounted on one side of the base board section 11. The base board section 11 and the guide board section 12 define therebetween a coin slide way 10. An identifying member 13 (such as an oscillator circuit) is mounted on outer side of the identifying device 1 corresponding to the coin slide way 10 so as to identify whether the coin C sliding through the coin slide way 10 is a true one or a fake one.

The receiving device 2 includes a frame body 21 mounted at the bottom end of the identifying device 1. The top section of the frame body 21 is formed with an inner guide way 211 for accepting the coin C dropping from the identifying device 1. The bottom end of the guide way 211 are communicated with both a first and a second coin releasing ways 212, 213. Two projecting shafts 214, 215 are radially disposed on outer side of the frame body 21. The top ends of two gate boards 22*a*, 22*b* via two pivot shafts 221*a*, 221*b* are respectively pivotally mounted at the top sections of the first and second coin releasing ways 212, 213. Two guide pins 222*a*, 222*b* respectively transversely project from two sides of the gate boards 22*a*, 22*b* near top ends thereof. The guide pins 222*a*, 222*b* are respectively slidably positioned in two guide slots 216*a*, 216*b* formed on two lateral walls of the frame body 21 for deflecting the gate boards to open or close the first and second coin releasing ways 212, 213. The first ends of the two swinging members 23*a*, 23*b* are respectively pivotally mounted on the projecting shafts 214, 215 of the frame body 21. The swinging members 23*a*, 23*b* are respectively formed with two linking slots 213*a*, 231*b*. The guide pins 222*a*, 222*b* of the gate boards 22*a*, 22*b* are respectively slidably fitted in the linking slots 213*a*, 213*b*. Two swinging type electromagnetic valves 24*a*, 24*b* are respectively fixedly mounted on two sides of the frame body 21. Each electromagnetic valve 24*a*, 24*b* has a rocking arm 241*a*, 241*b* slidably positioned in a slide way 232*a*, 232*b* of the swinging member 23*a*, 23*b* for operating and driving the swinging member 23*a*, 23*b* to swing up and down, whereby the linking slots 231*a*, 231*b* of the swinging members 23*a*, 23*b* drivingly rotate the gate boards 22*a*, 22*b* pivotally mounted at the incoming ends of the first and second coin releasing ways 212, 213 so as to open or close the same. Under such circumstance, the coin C is guided to drop out from the first or second coin releasing way 212 or 213.

Figure 3:
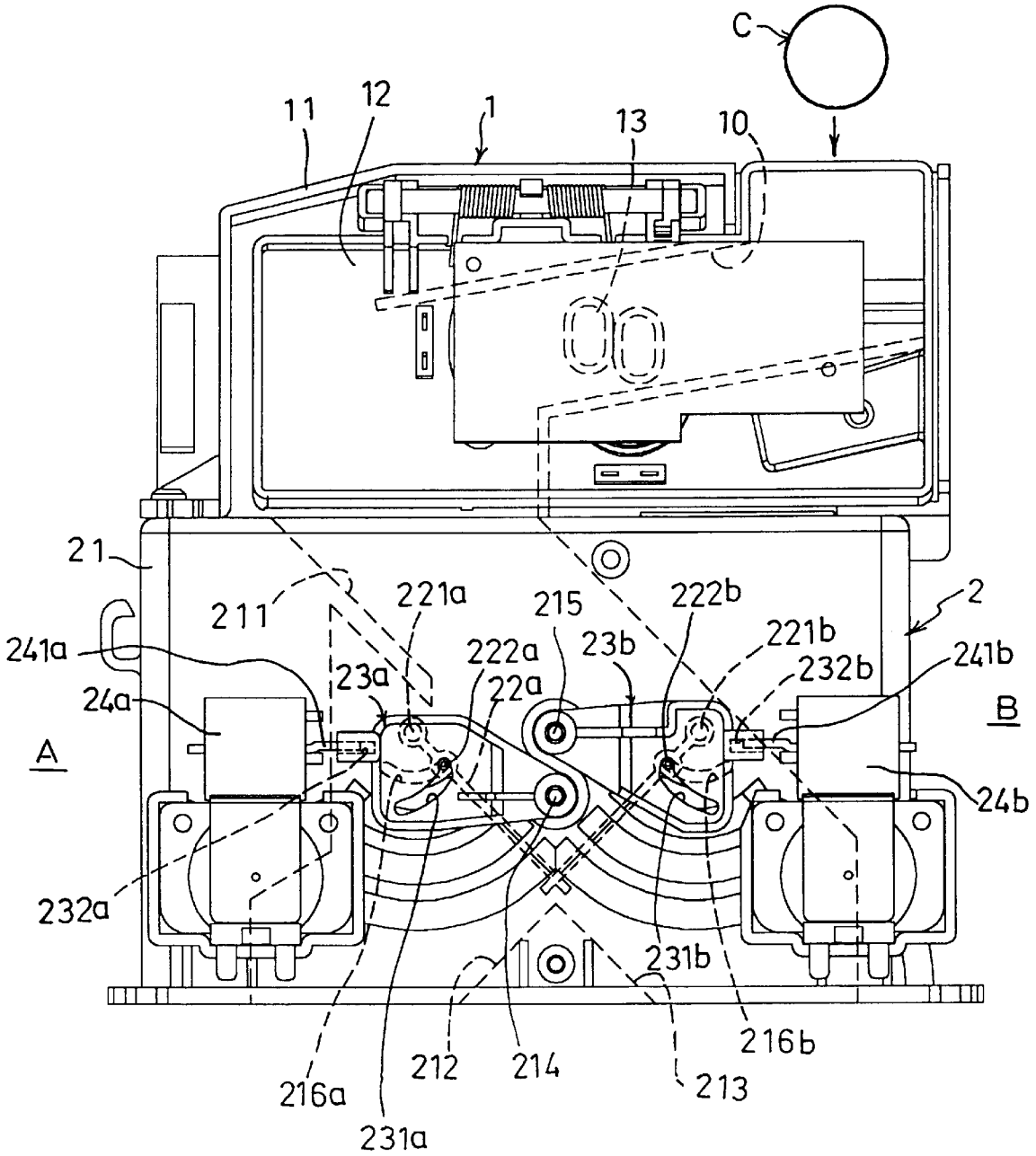
FIG. 3 is a plane view of the present invention.
Figure 4:
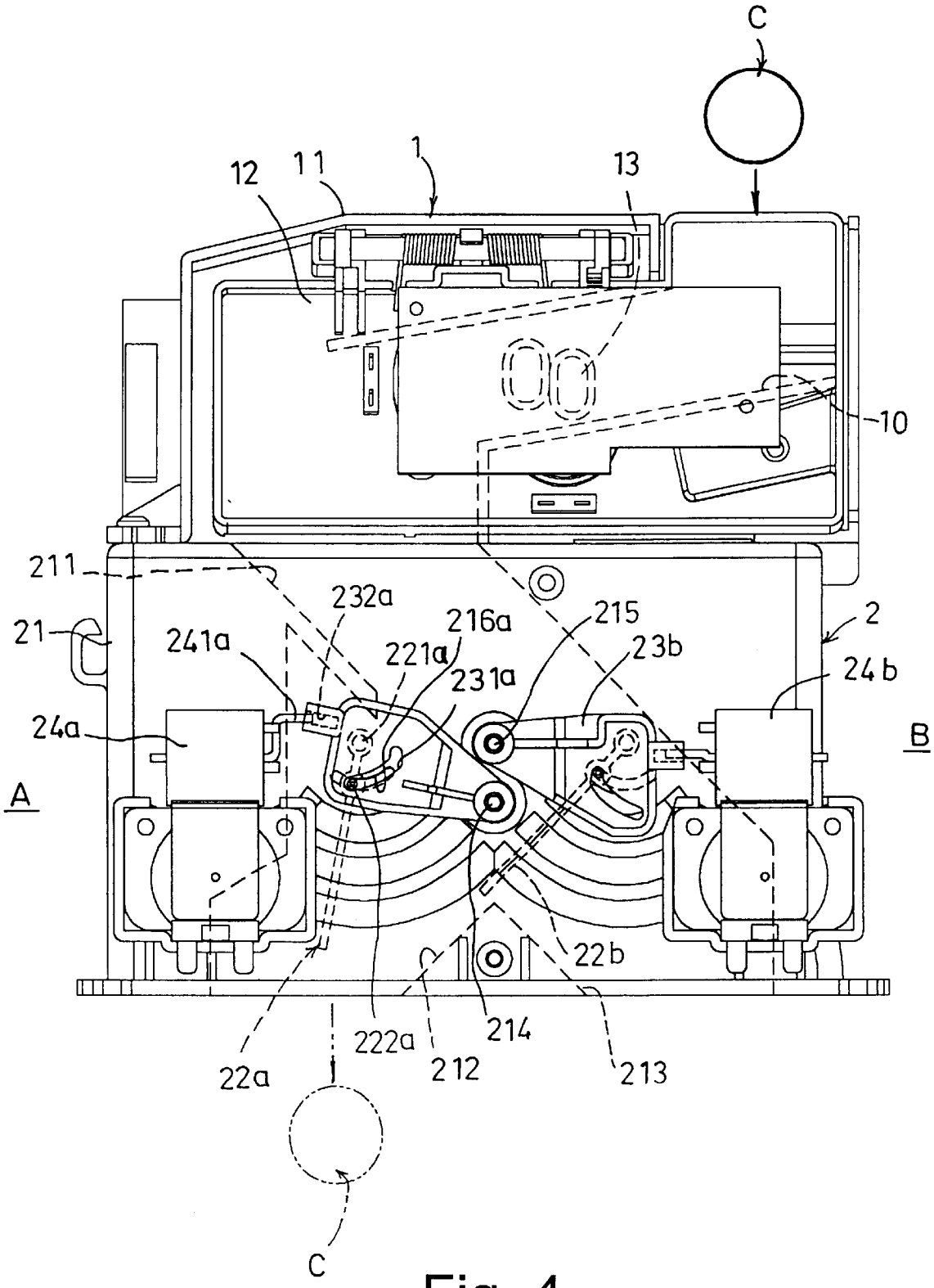
FIG. 4 is a view according to FIG. 3, showing that the first coin releasing way of the present invention is opened.
Figure 5:
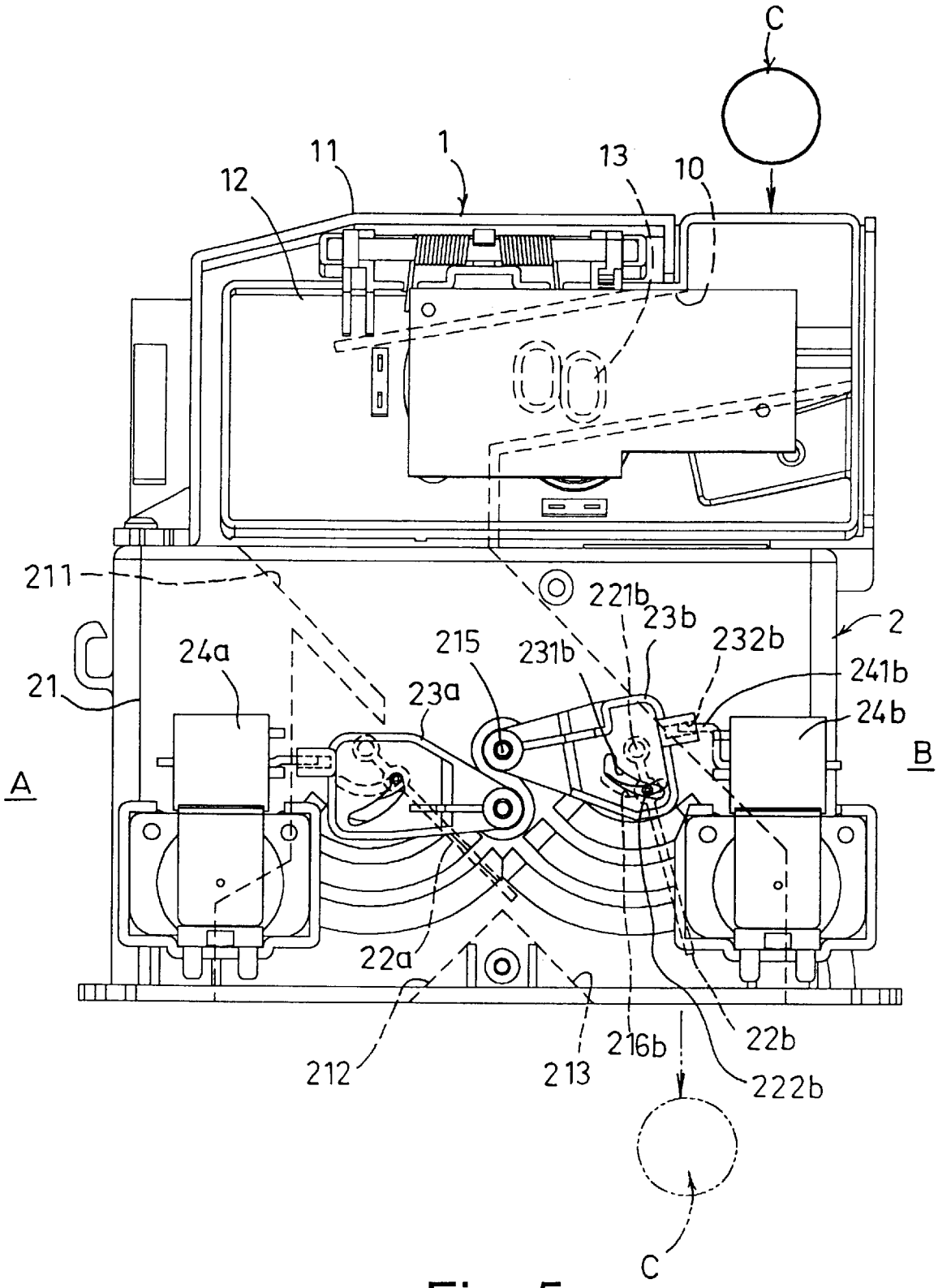
FIG. 5 is a view according to FIG. 3, showing that the second coin releasing way of the present invention is opened.
Figure 6:
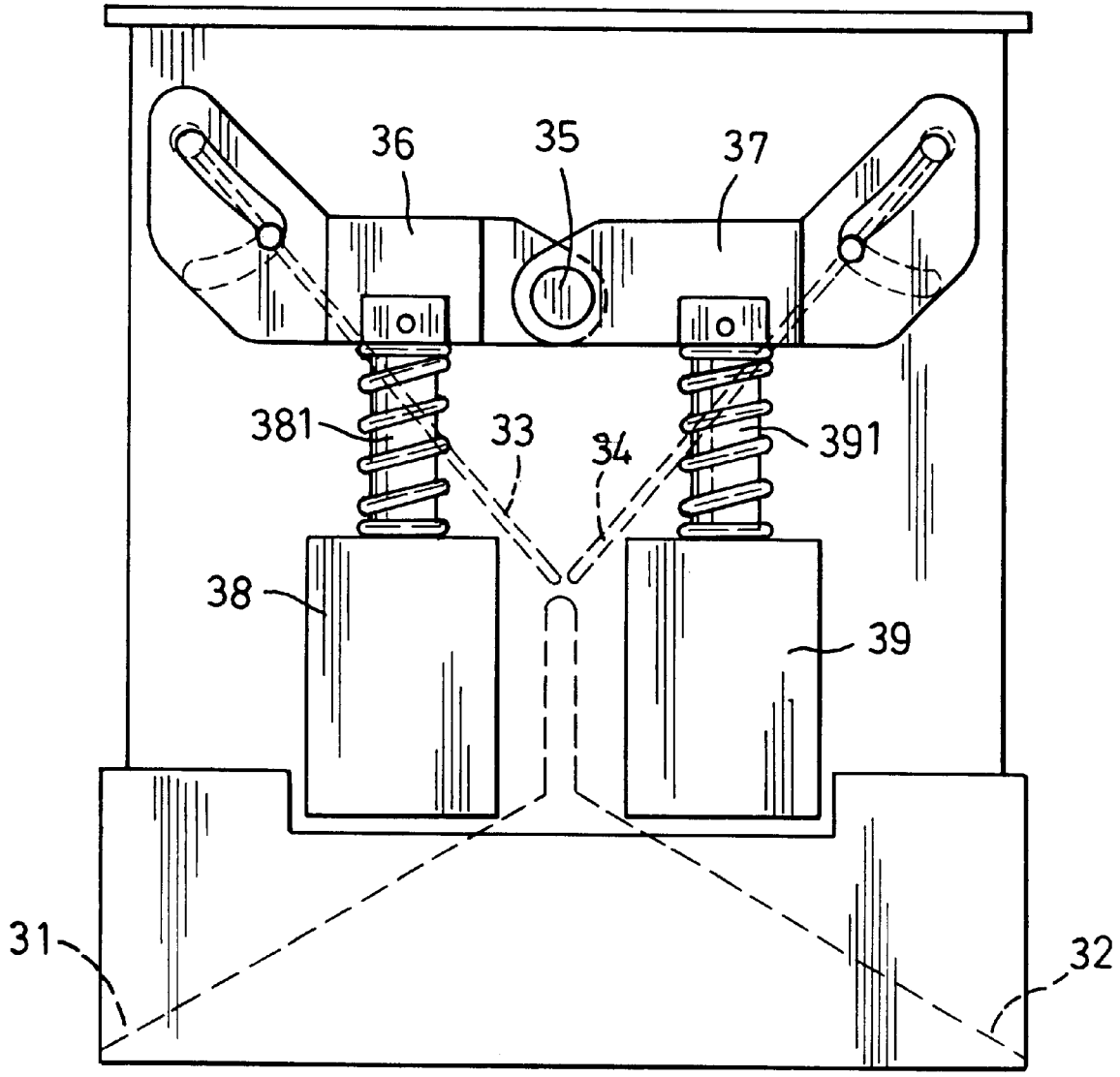
Fig. 6 PRIOR ART
FIG. 6 is a view showing a conventional coin-Identifying/receiving device.

In use of the above coin identifying/receiving device of the present invention, when the identifying device 1 identifies an inserted coin C to be fake or true, the rocking arm 241*a* of one of the swinging type electromagnetic valve 24*a* is triggered to drive the swinging member 23*a* pivotally mounted on a first side A of the frame body 21 to swing upward. At this time, the gate board 22*a* pivotally mounted at the first coin releasing way 212 is deflected downward as shown in FIG. 4 to open the first coin releasing way 212, permitting the coin C to drop out therefrom for collection. However, in the case that the coin C is identified to be fake, the appliance (such as a public phone) will not accumulate the value of the coin inserted by a user, that is, the fake coin will be taken in without being rejected to the user. In the case of a true coin C, the appliance will accumulate the value of the coin and after the coin C totally drops out, the rocking arm of the swinging type electromagnetic valve 24*a* will drive the swinging member 23*a* on the first side A of the frame body 21 to swing downward. At this time, the gate board 22*a* pivotally mounted at the first coin releasing way 212 is deflected upward as shown in FIG. 3 to re-close the first coin releasing way 212. On the other hand, in the case that after inserting the coin C, the user regrets inserting the coin and desires the coin to be rejected, the user can press a rejection button (not shown). At this time, the rocking arm 241*b* of the other swinging type electromagnetic valve 24*b* is triggered to drive the swinging member 23*b* pivotally mounted on a second side B of the frame body 21 to swing upward. At this time, the gate board 22*b* pivotally mounted at the second coin releasing way 213 is deflected downward as shown in FIG. 5 to open the second coin releasing way 213, permitting the coin C to drop out therefrom to return to the user. The above application type can be modified in accordance with the using state of different appliances without limitation.

In the twin-shaft swinging type coin-identifying/receiving device of the present invention, the two swinging members 23*a*, 23*b* for driving the two gate boards 22*a*, 22*b* are respectively pivotally mounted on two different projecting shafts 214, 215. Therefore, when swinging, the swinging members 23*a*, 23*b* will not abrade each other. In addition, the number of times and of friction of the projecting shafts 214, 215 is reduced. Therefore, the using life of the device is prolonged.

The twin-shaft swinging type coin-identifying/receiving device of the present invention has the following advantages:

1. The two swinging members 23*a*, 23*b* are respectively pivotally mounted on two different projecting shafts 214, 215 so that the friction between the respective components is reduced and the using life of the device is prolonged.

2. The two swinging members 23*a*, 23*b* are respectively driven by two swinging type electromagnetic valves 24*a*, 24*b* which save power and more precisely operate than the conventional device.

The above embodiments are only used to illustrate the present invention, not intended to limit the scope thereof. Many modifications of the above embodiments can be made without departing from the spirit of the present invention.

What is claimed is:

1. A twin-shaft swinging type coin-identifying/receiving device comprising:

an identifying device including a base board section and a guide board section resiliently pivotally mounted on one side of the base board section, the base board section and the guide board section defining therebetween a coin slide way, an identifying member being mounted on an outer side of the identifying device for identifying whether a coin sliding through the coin slide way is a true one or a fake one; and, a receiving device installed at a bottom end of the identifying device, the receiving device including:

a frame body mounted at the bottom end of the identifying device, a top section of the frame body being formed with an internal guide way for accepting a coin dropped through the identifying device, a bottom end of the guide way being communicated with both a first and second coin releasing way, two projecting shafts being laterally disposed on an outer side of the frame body;

two gate boards, top ends of the gate boards being respectively pivotally mounted at top section of the first and second coin releasing ways via two pivot shafts;

two guide pins respectively transversely projecting from ywo sides of the gate boards near top ends thereof, the guide pins being respectively slideable positioned in two guide slots formed on two lateral walls of the frame body for deflecting the gate boards to open or close the first and second coin releasing ways;

two swinging members, first ends of the two swinging members being respectively pivotally mounted on the projecting shafts of the outer side of the frame body, the swinging members being respectively formed with two linking slots, the guide pins of the gate boards being respectively slidably fitted in the linking slots; and two swinging type electromagnetic valve fixedly mounted on the outer side of the frame body, each electromagnetic valve having a rocking arm slidably positioned in a slide way of the swinging member for operating and driving the swinging member to swing up and down, whereby the linking slots of the swinging members driving rotate the gate boards pivotally mounted at the incoming ends of the first and second coin releasing ways so as to open or close the same.

2. Coin-receiving device comprising:

(a) a frame body, a top section of the frame body being formed with an inner guide way for guiding coins inward, a bottom end of the guide way being communicated with both a first and a second coin releasing ways, two projecting shafts being radially disposed on outer side of the frame body;

(b) two gate boards, top ends of the two gate boards via two pivot shafts being respectively pivotally mounted at the top sections of the first and second coin releasing ways, two guide pins respectively transversely projecting from two sides of the gate boards near top ends thereof, the guide pins being respectively slidably positioned in two guide slots formed on two lateral walls of the frame body for deflecting the gate boards to open or close the first and second coin releasing ways;

(c) two swinging members, first ends of the two swinging members being respectively pivotally mounted on the projecting shafts of the frame body, the swinging members being respectively formed with two linking slots, the guide pins of the gate boards being respectively slidably fitted in the linking slots; and (d) two swinging type electromagnetic valves respectively fixedly mounted on two sides of the frame body, each electromagnetic valve having a rocking arm slidably positioned in a slide way of the swinging member for operating and driving the swinging member to swing up and down, whereby the linking slots of the swinging members drivingly rotate the gate boards pivotally mounted at the incoming ends of the first and second coin releasing ways so as to open or close the same.

* * * * *